US010082154B2

(12) United States Patent
Koivikko et al.

(10) Patent No.: US 10,082,154 B2
(45) Date of Patent: Sep. 25, 2018

(54) INTAKE CHANNEL ARRANGEMENT FOR A VOLUTE CASING OF A CENTRIFUGAL PUMP, A FLANGE MEMBER, A VOLUTE CASING FOR A CENTRIFUGAL PUMP AND A CENTRIFUGAL PUMP

(71) Applicant: Sulzer Management AG, Winterthur (CH)

(72) Inventors: Matti Koivikko, Kotka (FI); Sami Virtanen, Kotka (FI)

(73) Assignee: SULZER MANAGEMENT AG, Winterthur (CH)

( * ) Notice: Subject to any disclaimer, the term of this patent is extended or adjusted under 35 U.S.C. 154(b) by 492 days.

(21) Appl. No.: 14/791,331

(22) Filed: Jul. 3, 2015

(65) Prior Publication Data

US 2016/0131153 A1 May 12, 2016

(30) Foreign Application Priority Data

Nov. 6, 2014 (EP) ..... 14192067

(51) Int. Cl.
*F04D 29/40* (2006.01)
*F04D 29/42* (2006.01)
*F04D 1/00* (2006.01)

(52) U.S. Cl.
CPC ..... *F04D 29/4293* (2013.01); *F04D 1/00* (2013.01)

(58) Field of Classification Search
CPC ..... F04D 29/4293; F04D 29/406; F04D 29/42
USPC ..... 415/203
See application file for complete search history.

(56) References Cited

U.S. PATENT DOCUMENTS 2,268,358 A * 12/1941 Turner ..... F04D 1/04 415/199.3
9,470,233 B2 * 10/2016 Tamaki ..... F04D 29/4213
2014/0271162 A1 9/2014 Karl et al.

FOREIGN PATENT DOCUMENTS

DE 2602624 A1 7/1976
DE 102009010927 A1 2/2010
DE 202009018129 U1 4/2011
GB 2266750 A 10/1993

* cited by examiner

OTHER PUBLICATIONS

European Search Report dated May 6, 2015 for EP Application No. 14192067.8.

*Primary Examiner* — Igor Kershteyn
*Assistant Examiner* — Jason Fountain
(74) *Attorney, Agent, or Firm* — Global IP Counselors, LLP

(57) ABSTRACT

An intake channel arrangement includes an intake channel. The intake channel includes a first end with a first inner diameter, and a second end with a second inner diameter, the second inner diameter being smaller than the first inner diameter, a cross-sectional flow area and an adapter section arranged between the first and second ends, a first channel portion with a surface and the first inner diameter, an annular convex curvature surface joining at an angle to the surface of the first channel portion, the angle being 90°-110° between the surface of the first channel portion and a tangent of the convex curvature surface having a tangent point in an intersection of the surface of the first channel portion and the convex curvature surface, the annular convex curvature surface reducing the cross-sectional flow area from the first inner diameter to the second inner diameter.

14 Claims, 8 Drawing Sheets

INTAKE CHANNEL ARRANGEMENT FOR A VOLUTE CASING OF A CENTRIFUGAL PUMP, A FLANGE MEMBER, A VOLUTE CASING FOR A CENTRIFUGAL PUMP AND A CENTRIFUGAL PUMP

CROSS-REFERENCE TO RELATED APPLICATIONS

This application claims priority to EP 14192067.8, filed Nov. 6, 2014, the contents of which is hereby incorporated herein by reference.

BACKGROUND

Field of the Invention

The present invention relates to a novel intake channel arrangement for a volute casing of a centrifugal pump, a flange member, a volute casing for a centrifugal pump and a centrifugal pump. The present invention relates especially to a novel volute casing producing a substantially constant suction specific speed for different pumps of a centrifugal pump series.

Background Art

The main components of a centrifugal pump having an influence on the pumping characteristics thereof are an impeller, a volute casing, and especially, an intake channel thereof leading the medium to be pumped to the impeller. There are basically three types of impellers. A so-called open impeller, is generally formed of a hub and working vanes attached to the hub. The hub is provided with a central hole for fastening the impeller to the shaft of the pump. If the hub is extending radially outwardly by a so-called rear plate or shroud to which the working vanes are arranged at their rear edges, the impeller is called a semi-open impeller, i.e. the front edges of the working vanes being free or open. If the front edges of the working vanes are fastened to a plate, so-called front plate or shroud, too, the impeller is called a closed impeller.

The volute casing comprises normally an intake channel, a front wall following, in the flow direction of the medium to be pumped, the intake channel and continuing radially outwardly, substantially following the shapes of the front edges of the working vanes or front shroud of the impeller, and a volute. Normally, a cross-section of the volute in an axial plane increases in a circumferential direction of rotation of the impeller up to a discharge outlet opening or a pressure outlet which is normally more or less tangential. The volute casing is fastened to a rear wall or a casing cover of the pump, and forms together with the rear wall or the casing cover of the pump a chamber or a cavity designed to house at least an impeller being usually of the radial or mixed flow type and mounted on a shaft for rotation when driven by a motor. The shaft is supported within a pump casing by bearings and a sealing such as a mechanical seal or packing box is provided for sealing the shaft in relation to the pump casing.

The impeller rotates around an axis of rotation in the pumping cavity formed between the front wall, the volute and a back or rear wall of the pump so as to pump the medium and to discharge the medium from the pump via the pressure outlet or the discharge duct. The discharge duct can be arranged tangentially to the volute casing or arranged radially by providing a so-called swan neck. The point where the discharge flow separates from the flow continuing its circulation in the volute casing is called a cutwater.

Centrifugal pumps are usually single stage pumps but two stage and multistage pumps are also in use in some applications.

There are two common volute casing types, i.e. a single suction type and a double suction type. In the case of the single suction type, the liquid is drawn from one axial side of the pump, and is pumped radially/tangentially out of the pump. In the double suction type, the pump draws the liquid from both opposite axial sides of the pump, and pumps the liquid radially/tangentially out of the pump.

Since a centrifugal pump can be designed to work optimally only at a certain substantially narrow performance (head, flow rate) range, each pump manufacturer designs a series of pumps (see FIG. 8) such that a user is able to find a suitable pump for all his/her pumping needs. Such a series of pumps has the same basic design, only the dimensions of the volute casings and the impellers are changed, i.e. the basic pump is scaled to a number of different sizes.

When a centrifugal pump is connected to the inlet pipeline, there is, almost always, a difference in diameters between the inlet pipeline and the inlet opening at the borderline between the intake channel and the front wall of the pump introducing the medium to be pumped to the effective area of the impeller. The difference in diameters is due to two facts: 1) metal pipes used for transferring pumpable media in industrial processes are manufactured in accordance with international pipeline standards, and 2) the performance requirements of the centrifugal pump, i.e. the desired head and flow rate dictate the diameter of the inlet opening of the centrifugal pump. As the dimensioning of the centrifugal pump, including the calculated diameter of the inlet opening, is designed to be optimal for the desired head and flow rate it is very seldom that the diameter of the inlet opening happens to match that of the pipeline.

The two diameters are usually made to match by arranging an appropriate reduction or increase in the diameter of the pump intake channel such that the diameter at the first end of the intake channel, i.e. that of the inlet flange, matches to the diameter of the inlet pipeline and the diameter at the second end of the intake channel to the calculated diameter of the inlet opening. Therefore, it has been common practice to form a substantially conically shaped intake channel in the volute casing in front of the impeller. When the intake channel is converging in the direction of flow, the flow is accelerated before its introduction to the effective area of the impeller. And when the intake channel is diverging in the direction of flow, the flow is decelerated before its introduction to the effective area of the impeller. In both cases, flow losses are created, though in the latter case the losses are significantly higher than in the former case. The magnitude of the losses depends on the dimensioning of the conical intake channel. A pump series thus consist of different sizes of pumps wherein the flow is accelerated in some pumps and decelerated in some other pumps before its introduction to the effective area of the impeller. It is important for the user of the pump to know the magnitude of the flow losses of the pump to be able to choose a tight pump for his/her applications. Since the flow losses of the pump itself are very well known, it is the changing or varying design of the suction or intake channel that forms a problematic and hard to predict source of flow losses.

Suction specific speed (NSS) is a parameter used in characterizing the operation of a centrifugal pump. It is mainly used to see if there will be problems with cavitation on the suction side during the pump's operation. In practice, the shape and dimensioning of the intake channel have a significant impact in the actual value of the NSS. The suction specific speed is discussed in more detail in, for instance, http://www.pumpingmachinery.com/pump_magazine/pump_articles/article_03/article_03.htm. The value for the NSS can be calculated by $$NSS = \frac{N[rpm] \cdot \sqrt{Q[m^3/s]}}{(NPSHR[m])^{0.75}},$$

where N is a rotational speed (revolutions per minute), Q is a pump capacity (cubic meter per second) and NPSHR is a net positive suction head required by the pump (meter) that is normally calculated at the best efficiency point (BEP). As can be seen, the NSS considered herein is calculated in SI units.

Thus, each pump has its characteristic NSS. And, naturally, the NSS's of all pumps or pump sizes of a pump series should be as close to each other as possible. In case there are significant deviations in the NSS's of different pumps or pump sizes, it will be difficult to determine which pump is optimal for a certain application. For instance, if the NSS of a certain pump size is lower than that of the other pump sizes, it means that the suction head is higher, whereby the pump in question cannot be used in an application requiring a low suction head, but a larger, and more expensive pump has to be chosen.

When using a conically shaped intake channel to match the centrifugal pump to the inlet pipeline, the intake channel will affect the suction specific speed of more or less all pump sizes in a pump series, as the conical intake channels of different pump sizes have (most probably) different dimensions. The basic reason for such deviations in the NSS is the fact that the losses generated by the conically shaped intake channels vary depending on the design of the cone. In accordance with performed calculations the suction specific speed of centrifugal pumps of a prior art pump series varies ±5-7% around the average NSS value, i.e. the total variation being 10 to 14%. It means, in practice, severe difficulties in determining which pump is ideal for the customer's application.

SUMMARY

Thus, in view of the above, it is clear that the suction specific speeds of various pumps within a pump series should not vary at all or as little as possible.

A way to control the NSS would be to design the conical intake channel in view of the NSS, but such could lead, among other problems, to some conically converging intake channels having a substantial length, which means the use of a lot of material and weight leading to more costs, installation problems due to varying space requirements, etc. whereby it is an unwanted property for pump constructions.

Therefore, an object of the present invention is to design such a centrifugal pump that is suitable for different purposes and has minimal deviations in suction specific speeds.

Another object of the present invention is to design a volute casing for a centrifugal pump in which the performance is considerably improved compared to the prior art solutions.

A further object of the present invention is a novel intake flange arrangement of the intake channel of the centrifugal pump.

A still further object of the present invention is to facilitate the fastening of the centrifugal pump to the inlet piping by an advantageous flange arrangement without hampering the flow profile.

A part of the above discussed problems is avoided by designing the overall pump hydraulics such that a significantly higher volume flow passes the pump whereby there is no more need to increase the diameter from the intake piping to the pump inlet, but a converging adapter section is the only one that needs to be used. However, the novel hydraulic design does not take away the fact that the conically converging intake channel has either a variable length (not a desired feature due to changes in the pump dimensions) or a variable cone angle (having significant effect on flow losses).

Particularly, an object of the invention is met by an intake flange arrangement for a volute casing of a centrifugal pump, the intake channel comprising a first end with a first inner diameter and a second end with a second inner diameter, the second inner diameter being smaller than the first inner diameter, the intake channel having a cross-sectional flow area, wherein an adapter section arranged between the first end and the second end and comprising an annular convex curvature surface reducing the cross-sectional flow area from the first inner diameter to the second inner diameter and that the first inner diameter is chosen to correspond to the first available standard pipeline inner diameter greater than the second diameter.

The present invention concentrates on designing the intake channel of a centrifugal pump to be as short as possible, while simultaneously minimizing the effect of the intake channel construction on the NSS. In practice, it means such a novel design for the converging adapter section that irrespective of the amount of convergence the intake channel is short and the effect of the design of the adapter section to the NSS is low.

Thus, another object of the invention is met by a centrifugal pump comprising a volute casing having an intake channel and an adapter section being arranged in connection with the intake channel. It is characteristic to the invention that the adapter section comprises a smooth convex curvature surface, which is an annular surface reducing cross-sectional flow area in the intake channel.

This provides a centrifugal pump series of which the performance characteristics of the pumps are considerably improved. The centrifugal pump series needs to be understood in this context as a series of centrifugal pumps in different sizes, i.e. a centrifugal pump series is a pump family consisting of a number of centrifugal pumps of different sizes but having the same hydraulic design. The centrifugal pump series may, for example, comprise tens of different sizes of centrifugal pumps. It should be also noted, that in the conventional centrifugal pump series the suction specific speed varies about 11%, whereas the NSS varies in the pumps of the present invention less than 3%. Therefore, the centrifugal pumps according to the invention provides significantly better pump characteristics.

Another object of the invention is substantially met by a volute casing for a centrifugal pump, the volute casing comprising an intake channel, a front wall and a volute, the intake channel having an inlet flange, a cross sectional flow area and an adapter section being arranged in connection with the intake channel, wherein the adapter section comprises a convex curvature surface S, which is an annular surface reducing the cross-sectional flow area.

This provides a volute casing of which the performance characteristics of a centrifugal pump are considerably improved. Particularly, this provides an advantageous curved structure for the convex curvature surface that can affect the flow profile. The inventors of the present invention have noticed that, even though this design for the volute casing produces certain, though small, losses, it surprisingly results in series of volute casings having very small deviations in suction specific speeds between different volute casings of the series. The losses generated by the volute casing of the invention are, however, very small in comparison to the overall efficiency of the pump. This is mainly due to the fact that there is no need to reserve any considerable safety factor/margin for the suction specific speeds, which makes also the pump to be very compact in shape. This means that the volute casings in accordance with the invention are much smaller in their sizes compared to prior art volute casings. Additionally, the smaller volute casing in accordance with the invention provides a pump design that has as good as or greater overall efficiency than the larger prior art solutions.

The volute casing is suitable for pump series designed for process industry, for instance, pulp and paper industry. The volute casings of the pump series are suitable for fluids such as water, dilute fibre suspension or viscous fibre suspension. It should also be noted that the direction of flow refers to the case when the volute casing is assembled in the pump system and particularly when in use. The direction of flow is a direction in the intake channel when moving from the inlet flange towards the front wall up to a second end where the second channel portion joins to the front wall.

Thus, it is easy to assemble different sizes volute casings and pump series, which all have very small deviations in suction specific speeds. The convergent shape in the intermediate portion of the intake channel is very cheap to manufacture and works always in the same predictable manner. Therefore, the losses and deviations in suction parameters are substantially the same in all different sizes of volute casings and they are, thus, easy to predict. The flow profile is always accelerated. This also solves a problem how to efficiently handle different diameter sizes in the pipe lines and the inlet flanges.

Other characteristic features of the present invention may be seen in the appended claims.

BRIEF DESCRIPTION OF DRAWINGS

In the following, the present invention will be described with reference to the accompanying exemplary, schematic drawings, in which.

DETAILED DESCRIPTION OF THE EMBODIMENTS

Figure 1:
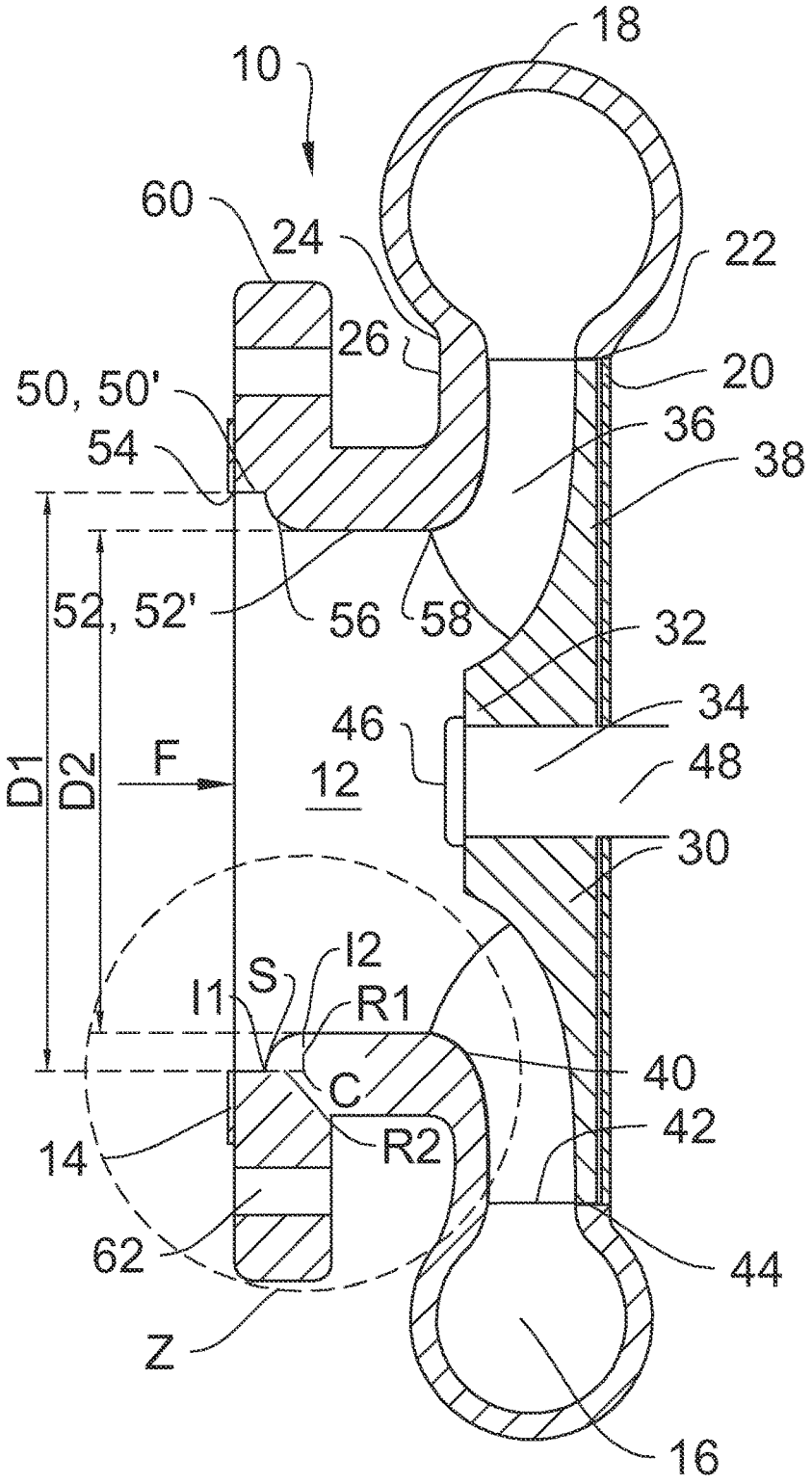
FIG. 1 illustrates an axial cross sectional view of a volute casing for a single suction centrifugal pump in accordance with a first preferred embodiment of the present invention.

FIG. 1 depicts schematically a general cross sectional view of a centrifugal pump showing a volute casing 10 housing an impeller 30 that is arranged with a fastening means (or device) 46 on a shaft 48. The volute casing 10 comprises an intake channel 12, a front wall 26 facing the impeller 30 and a volute 16 radially outside the impeller 30. The intake channel 12 receives medium to be pumped from an inlet piping arranged upstream of the pump and introduces the medium to an effective area of the impeller 30. The impeller 30 rotates in a pumping cavity delimited by the front wall 26 of the volute casing 10, the volute 16 and a rear wall or a casing cover 20 of the pump. The volute is an outer part of the pumping cavity into which the impeller 30 pumps the medium. The medium to be pumped circulates (in the circumferential direction) in the volute 16 before being discharged from the pump via a discharge or pressure outlet 64 (shown in FIG. 7). In other words, the intake channel 12 allows medium to be pumped to enter to the pumping cavity.

The volute 16 has a substantially annular wall 18 (in a radial cross section) starting from an inner circumference 22 of the annular wall 18 facing the rear wall 20 of the pump and terminating at 24 to the front wall 26 of the volute casing 10. The inner circumference 22 and the rear wall 20 of the pump define a central rear opening via which the impeller 30 is assembled in the pumping cavity.

The impeller 30 illustrated, as a cross section in a plane running along the axis of the impeller, in FIG. 1 is a so-called semi-open impeller, i.e. having a hub 32 with a central opening 34 for the shaft 48, working vanes 36 and a rear plate or shroud 38. The working vanes 36 have a front edge 40 which is facing an inner surface of the front wall 26 of the volute casing 10 and arranged, in an assembled centrifugal pump, at a certain running distance from the front wall 26 of the volute casing 10 and a radially outer or trailing edge 42, which faces an opening to the volute 16 of the volute casing 10. The rear plate or shroud 38 of the impeller 30 has an outer circumference 44 which is arranged in close proximity of the inner circumference 22 of the annular wall 18 of the volute 16. However, in case the impeller has so-called rear vanes that is vanes at the rear side of its rear plate or shroud 38, the outer circumference 44 of the rear plate 38 leaves a gap in both axial and radial direction between itself and the inner circumference 22 of the annular wall 20 of the volute 16 for the medium pumped by the rear vanes to enter the volute 16. The rear wall 20 is often substantially parallel to a plane of the rear plate 38. It should be noted that any other type than the semi-open impeller is possible. Therefore, the impeller type is not restricted by any means to semi-open impellers. The semi-open impeller is shown herein just for illustrative purposes only and to clarify the structure of the centrifugal pump.

Advantageously, in accordance with a first preferred embodiment of the present invention the intake channel 12 is formed of three channel portions: a first channel portion 50 having a first inner diameter D1, a second channel portion 52 having a second inner diameter D2 and an intermediate portion or an adapter section 56 between the first channel portion 50 and the second channel portion 52. The first inner diameter D1 of the first channel portion 50 defines an inner surface 50' of the first channel portion 50 and the second inner diameter D2 of the second channel portion 52 defines an inner surface 52' of the second channel portion 52. The first inner diameter D1 equals to an inner diameter of an inlet flange 60 of the volute casing 10 as illustrated in FIG. 1. The first inner diameter D1 is chosen such that it fulfils the following requirements: 1) it is equal with a standardized inner diameter of such pipelines or tubes used as the inlet pipelines of a centrifugal pump, and 2) it is equal with, or the first available standard diameter greater than, D2. The second inner diameter D2 equals to a diameter of an inlet or suction opening introducing the medium to be pumped to the effective area of the pump impeller 30 or to the pumping cavity.

More specifically, the intake channel 12 extends between its origin at a first end 54 thereof, at the level of the inlet flange 60 and a second end 58 where the intake channel 12 joins the front wall 26 of the volute casing 10. The intake channel 12 extends from its first end 54 towards its second end 58 up to the intermediate portion 56 so as to form the first channel portion 50. The second channel portion 52 has its origin at the intermediate portion 56 from where it extends up to its second end 58. In other words, the first end 54 of the intake channel 12 is opposite to the second end 58 of the intake channel 12. An inner diameter of the second end 58 of the intake channel is substantially equal to the second inner diameter D2. In other words, the second end 58 of the intake channel defines the inlet or suction opening for introducing the medium to be pumped to the effective area of the pump impeller 30 or to the pumping cavity. Therefore, it can be said that an intake flange arrangement comprises an initial portion forming the first channel portion 50 of an intake channel 12 having the first inner diameter D1 so as to form a cross sectional flow area, and the adapter section 56 being arranged in connection with the initial portion so as to form the intermediate portion of the intake channel 12. Furthermore, due to the fact that the second channel portion 52 is located directly upstream the impeller and via the second channel portion 52 the medium is introduced into the pumping area, the second channel portion 52 can be also called as an end portion of the intake channel 12.

As illustrated in FIG. 1, the intake channel 12 converges in a direction of flow F from the first inner diameter D1 of the first intake portion 50 to the second inner diameter D2 of the second channel portion 52 at the adapter section 56 with an annular (substantially continuously smooth) surface S having a convex curvature against the flow, i.e. the convex curvature surface reduces the cross sectional flow area from that of the first channel portion 50 of the intake channel 12 to that of the second channel portion 52 of the intake channel 12. As illustrated in FIG. 1, a length of the first channel portion 50 is substantially shorter than the second channel portion 52.

The annular surface S is convex against the direction of flow F and has, in this embodiment, a cross section with a first radius R1 with respect to a centre C of the cross section of the convex curvature surface S. The flow F refers to the flow in the intake channel and the direction of flow refers in this context to the case when the volute casing is assembled in the pump system and particularly when in use. In figures the direction of flow in the intake channel, in particular, is indicated by the character F. Specifically, the direction of flow F is a direction when moving from the inlet flange 60 towards the rear wall 20. More specifically, the direction of flow F is a direction when moving from the first end 54 to the second end 58 of the intake channel 12.

Here, the first radius R1 is defined to be perpendicular to the inner surface 52' of the second channel portion 52. A length of the first radius R1 can be obtained as a difference of the first inner diameter D1 and the second inner diameter D2 and then divided by two that is (D1−D2)/2. In other words, the first radius R1 of the cross section of the annular convex curvature surface S can be obtained as a difference between a radius of the first channel portion 50 and a radius of the second channel portion 52. In other words, the convex curvature surface S joins tangentially to the surface 52' of the second channel portion 52. The cross section of the annular surface S has a second radius R2 with respect to the centre C of the cross section of the convex curvature surface S and a line defining the second radius R2 is perpendicular to a line defining the first radius R2. The second radius R2 is defined to be parallel to the inner surface 52' of the second channel portion 52 and the inner surface 50' of the first channel portion 50. In case the first radius R1 equals to the second radius R2, i.e. R1=R2, the annular surface has a cross section curvature of a circle. The cross section of the convex curvature surface S can be substantially a quarter of a circle having a centroid in the centre C of the convex curvature surface S as indicated in FIG. 1. This means that the first radius R1 and the second radius R2 does not differ. The quarter of the circle is particularly a radial cross section of the annulus that has a cross section of a circle.

According to another variant of the invention, preferably, the first channel portion 50 of the intake channel 12 can be substantially short, the length starting from 0 mm, extending possibly a few millimetres in the axial direction towards the impeller 30 from the origin of the first end 54 of the first channel portion 50 upstream of the convex curvature surface S in the intermediate channel portion or adapter section 56. In other words, a length with respect to the direction of the flow F of the first channel portion 50 is only from zero millimetres to a few millimetres. More specifically, according to an embodiment of the invention, a length of the first channel portion 50 is smaller than a length of the second channel portion 52. However, it is also possible that the length of the second channel portion may be zero millimetres, whereby the intake channel, at its minimum, comprises only the convex curvature surface, which, at its trailing edge forms the pump inlet opening and connects to the front wall of the volute casing without any cylindrical second channel portion. The length of the first channel portion 50 is preferably 70%-80% shorter, more preferably 80%-90% shorter or most preferably 90%-100% shorter than the length of the second channel portion 52. Namely, the convex curvature surface S accelerates the flow always in the same way and the desirable flow profile is obtained advantageously in a substantially short intake channel 12. In accordance with the present invention, the first inner diameter D1 of the first channel portion 50 equals to the outlet diameter of the pipe attached to the inlet flange 60. Thus, the fluid flowing from the pipe into the intake channel 12 is accelerated by reducing the diameter of the intake channel 12 by the convex curvature surface S and the second channel portion 52 with the smaller inner diameter D2. This also means, in practice, that the length of the intake channel 12 may be reduced significantly compared to prior art solutions. This also reduces the mass of the volute casing 10 and, thereby, manufacturing costs. Also, the axial space required by the pump is reduced.

As illustrated in FIG. 1, neither the hub 32 of the impeller 30 nor the fastening means 46 thereof extend into the intermediate portion 56 when assembled in the volute casing 10. Thus, the flow profile is generated in the intake channel 12 preferably mainly or more preferably merely by the convex curvature surface S in the intermediate portion 56 so obtaining an improved flow profile in the second channel portion 52.

Figure 2:
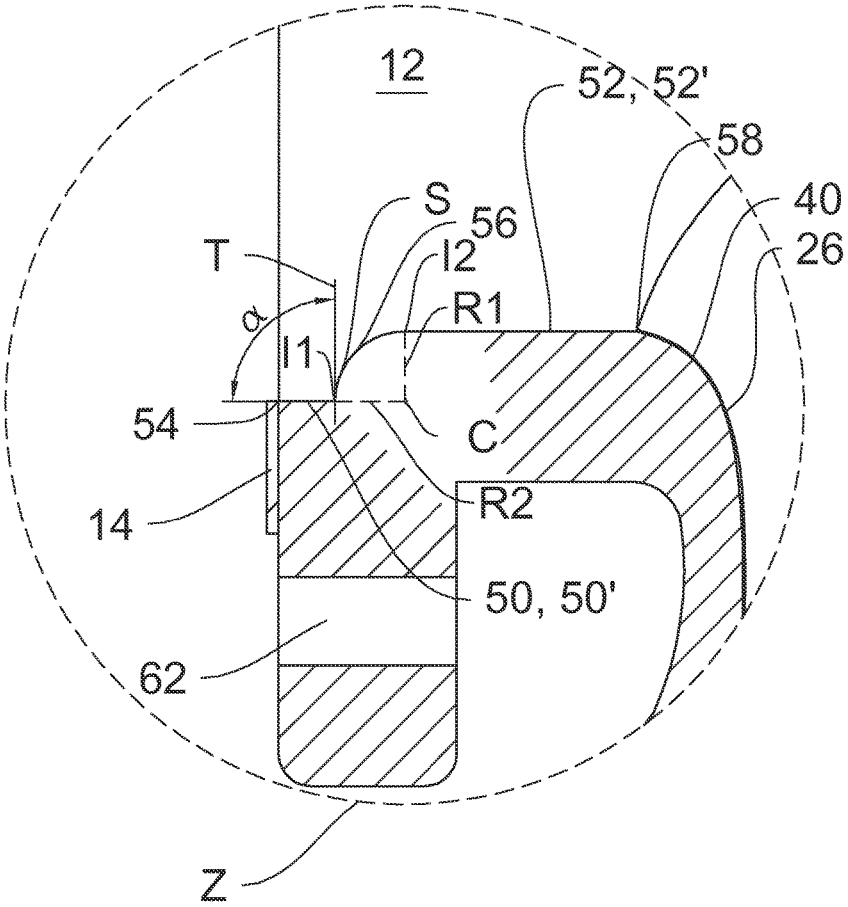
FIG. 2 illustrates a partial axial cross sectional view of detail Z of the volute casing for a single suction centrifugal pump of FIG. 1.

FIG. 2 shows a portion Z of an axial cross sectional view of the volute casing in accordance with FIG. 1. An angle α depicts an angle between the inner surface 50' of the first channel portion 50 and a tangent T of the convex curvature surface S. The tangent T of the convex curvature surface S touches the intersection I1 of the convex curvature surface S and the surface 50' of the first channel portion 50 as depicted in FIG. 2. In other words, a tangent point is located in the intersection I1 of the surface 50' of the first channel portion 50 and the convex curvature surface S. In a preferred embodiment of the invention, the angle α is in a range of 90°-110°. In a most preferred embodiment of the invention the angle α is 90° and the convex curvature surface S has a cross section in 2-dimensional space that is a quarter of a circle. The centroid of the quarter of the circle is located in the centre C of the annular convex curvature surface S. It should be noted that the first inner diameter D1 (shown in FIG. 1) of the first channel portion 50 is constant meaning that the first channel portion 50 does not converge or diverge in the direction of flow F (shown in FIG. 1—from the left to the right).

Particularly, as can be seen from FIG. 2, the angle α is 90° and a cross section of the convex curvature surface S has a cross section in 2-dimensional space that is the quarter of the circle. The cross section of the annular convex curvature surface S is substantially a quarter of a circle having a centroid in the centre C of the convex curvature surface S. More generally speaking, the cross section of the convex curvature surface is a portion of a circle, the first radius R1 can be called as a curvature radius.

Figure 3:
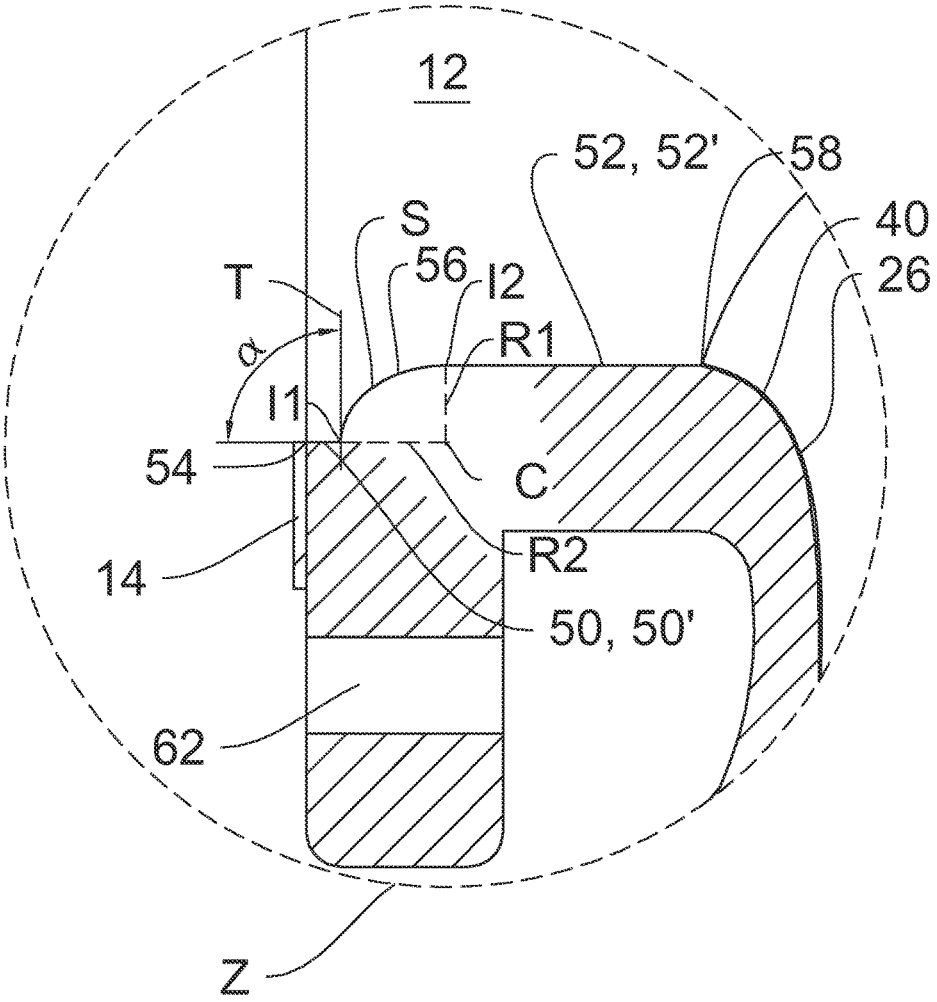
FIG. 3 illustrates a partial axial cross sectional view of detail Z of the volute casing for a single suction centrifugal pump in accordance with a second preferred embodiment of the present invention.

FIG. 3 illustrates a portion Z of an axial cross sectional view of the volute casing according to a second preferred embodiment of the present invention. Also in this embodiment, the convex curvature surface S joins tangentially to the surface 52' of the second channel portion 52. The angle α depicts an angle between the surface 50' of the first channel portion 50 and the tangent T of the convex curvature surface S. The tangent T of the convex curvature surface S touches an intersection I1 of the convex curvature surface S and the surface 50' of the first channel portion 50 as depicted in FIG. 3. The angle α equals to 90° in this embodiment. However, the first radius R1 of the cross section of the annular convex curvature surface S differs from the second radius R2 of the cross section of the annular convex curvature surface S. Particularly, in this embodiment, the annular convex curvature surface S has a cross section in 2-dimensional space that is a quarter of an ellipse. The centroid of the ellipse is located in the centre C of the cross section of the convex curvature surface S.

Figure 4:
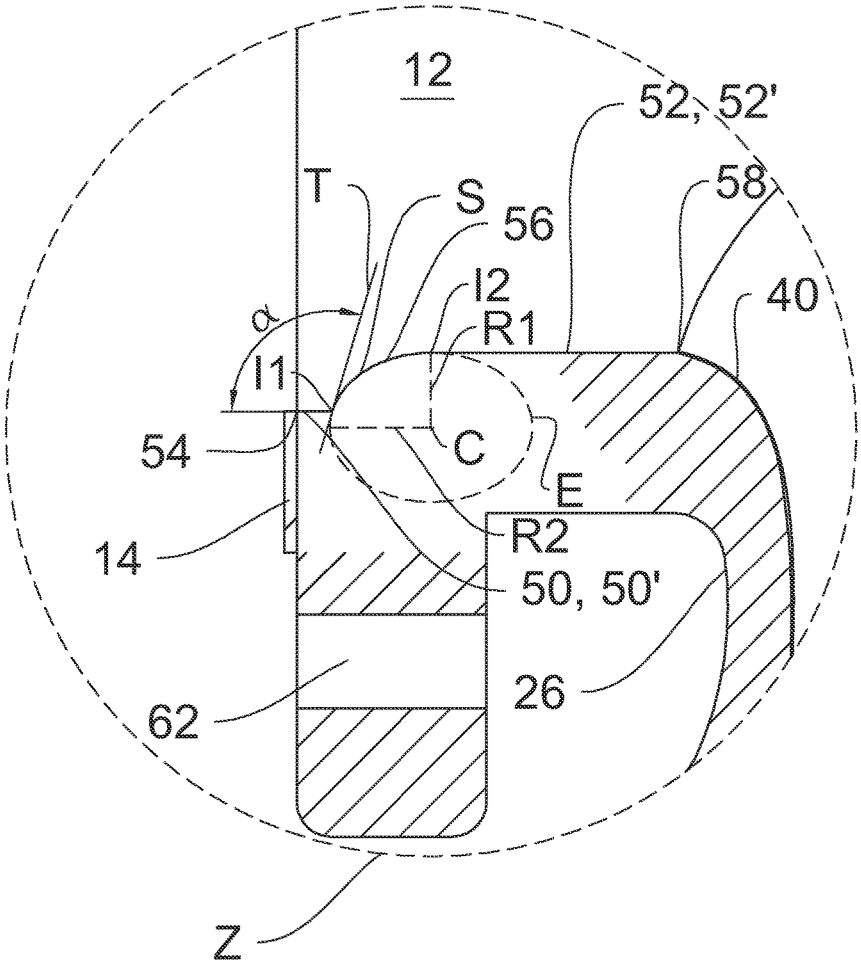
FIG. 4 illustrates a portion Z of an axial cross sectional view of the volute casing for a single suction centrifugal pump in accordance with a third preferred embodiment of the present invention.

FIG. 4 illustrates a portion Z of an axial cross sectional view of the volute casing according to a third preferred embodiment of the present invention, and more specifically illustrates a cross section of an annular convex curvature surface S wherein the angle α is greater than 90° but less than or equal to 110°. In particular, it is shown in detail how the tangent T is defined. The cross section of the annular convex curvature surface S is substantially a portion of an ellipse having a centroid C. Dashed line defines schematically the whole ellipse E and a cross section of the annular surface is defined by a portion of the ellipse E, i.e. a cross section of the convex curvature surface S in 2-dimensional space. Therefore, the tangent T can be defined having the angle α and having the tangent point in the portion of the ellipse located in the intersection I1 of the surface 50' of the first channel portion 50 and the convex curvature surface S. Also here, the convex curvature surface S joins tangentially to the surface 52' of the second channel portion 52.

Figure 5:
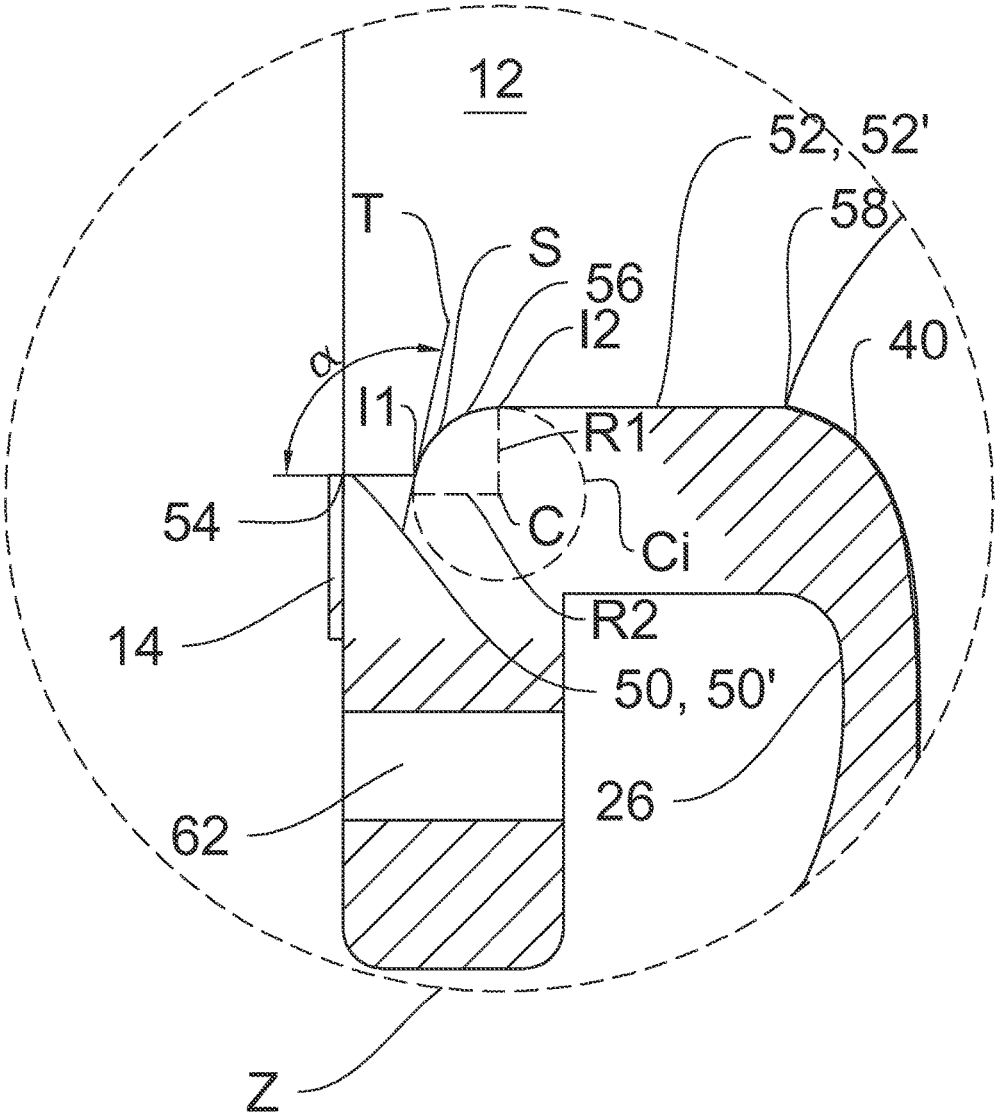
FIG. 5 illustrates a portion Z of an axial cross sectional view of the volute casing for a single suction centrifugal pump in accordance with a fourth preferred embodiment of the present invention.

Similarly, in the case when the cross section of the convex curvature S is substantially a portion of a circle having a centroid C of the convex curvature surface S as shown in FIG. 5, which illustrates a portion Z of an axial cross sectional view of the volute casing according to a fourth preferred embodiment of the present invention. The angle α is greater than 90° but less than or equal to 110° and the portion of the circle is less than a quarter of a whole circle. The whole circle Ci (smaller one) is denoted as a dashed line in FIG. 5. Also here, the convex curvature surface S joins tangentially to the surface 52' of the second channel portion 52.

Figure 6:
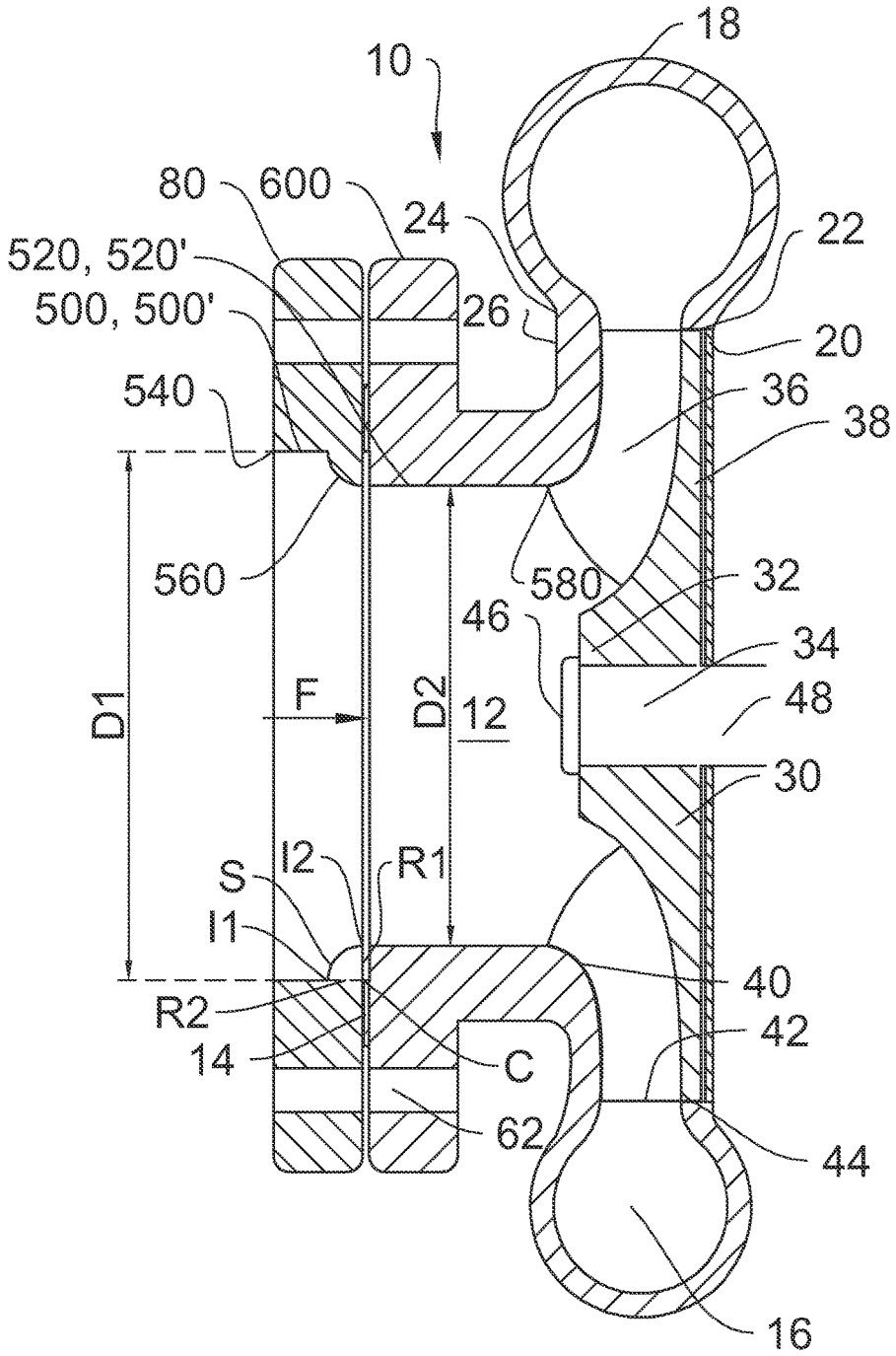
FIG. 6 illustrates an axial cross sectional view of a volute casing for a single suction centrifugal pump in accordance with a fifth preferred embodiment of the present invention.

FIG. 6 illustrates an axial cross sectional view of the volute casing according to a fifth preferred embodiment of the present invention. In other words, FIG. 6 shows a general cross sectional view of a centrifugal pump including a volute casing 10 having a flange 600 at the second channel portion 520 of the inlet channel for attaching an intermediate flange member 80 thereto. The flange member 80 comprises an adapter section or an intermediate channel portion 560 with the annular convex curvature surface S. The purpose of the flange member 80 is to act as an adapter between the standardized pipeline flange and the flange 600 of the volute casing. Also here, the convex curvature surface S joins tangentially to the surface 520' of the second channel portion 520.

More specifically, the intake channel 12 of the centrifugal pump is, in this embodiment, formed of three channel portions: a first channel portion 500 having a first inner diameter D1, a second channel portion 520 having a second inner diameter D2 and the intermediate channel portion or the adapter section 560 between the first channel portion 500 and the second channel portion 520. However, the first channel portion 500 and the adapter section or the intermediate portion 560 are arranged in the separate flange member 80. In other words, it can be said that the flange member 80 comprises the adapter section 560. The adapter section or in other words the intermediate portion 560 comprises the annular convex curvature surface S, which is an annular surface being convex against the direction of flow F so as to provide an accelerated flow profile in the inlet channel of the centrifugal pump and to provide a suction specific speed being substantially constant in different pumps of a centrifugal pump series.

The first inner diameter D1 of the first channel portion 500 defines an inner surface 500' of the first channel portion 500 and the second inner diameter D2 of the second channel portion 520 defines an inner surface 520' of the second channel portion 520. Furthermore, the first inner diameter D1 of the first channel portion 500 is greater than the second inner diameter D2 of the second channel portion 520. The flange member 80 is arranged replaceable to the inlet flange 60 of the volute casing 10.

In this embodiment, shown, as a cross section in a plane running along the axis of the impeller, in FIG. 6, a first end 540 of the first channel portion 500 has its origin at the end level of the flange member 80 upstream of the adapter section 560 in the direction of flow F. A second end 580 where the intake channel 12 joins the front wall 26 of the volute casing 10 is also illustrated in FIG. 6.

For the sake of clarity FIGS. 1-5 show holes 62 and sealing means (or device) 14 used when fastening the inlet piping via its flange (not shown) to the flange member 80 to the volute casing 10. The flange member 80 of FIG. 6 may comprise similar sealing members but those are not shown.

Figure 7:
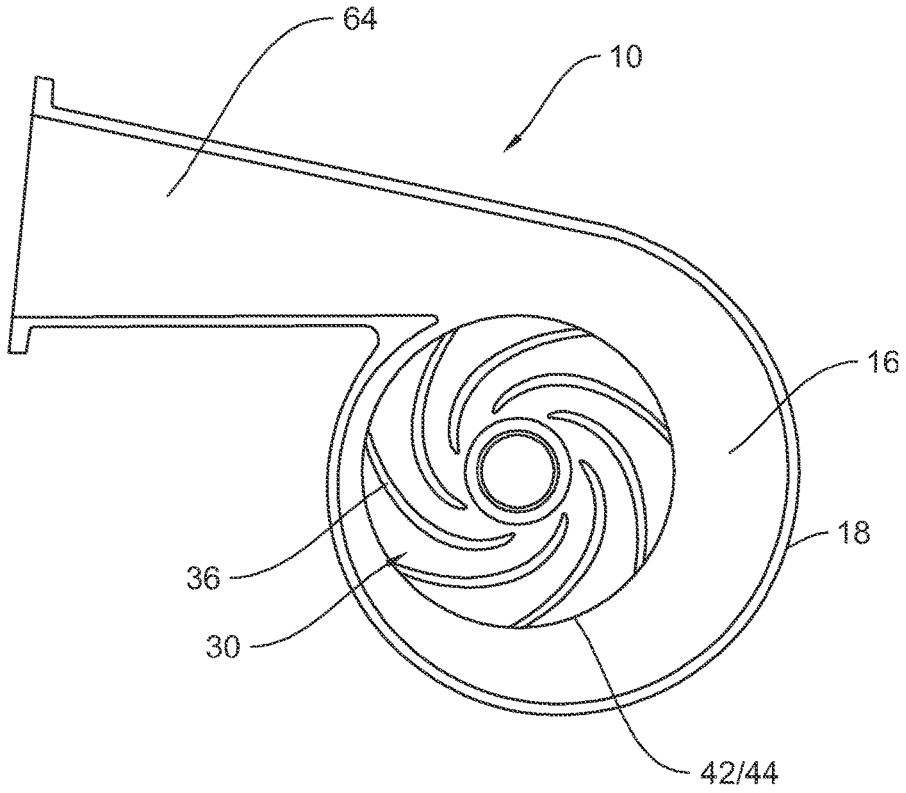
FIG. 7 illustrates schematically a radial cross section of a centrifugal pump in accordance with a sixth preferred embodiment of the present invention.

FIG. 7 illustrates schematically a radial cross sectional view of a volute casing 10 of the centrifugal pump. FIG. 7 illustrates the volute 16 wherefrom the medium is to be discharged into the pressure outlet or the discharge duct 64 for discharging the pumped medium from the pump. The cross section of the pressure outlet 64 is, in principle, circular whereby the overall shape of the outlet is, up to the end flange, conical. FIG. 7 also shows the working vanes 36 in the impeller 30, the outer edges 42 of the working vanes 36, or the outer edge of the rear plate 38.

Figure 8:
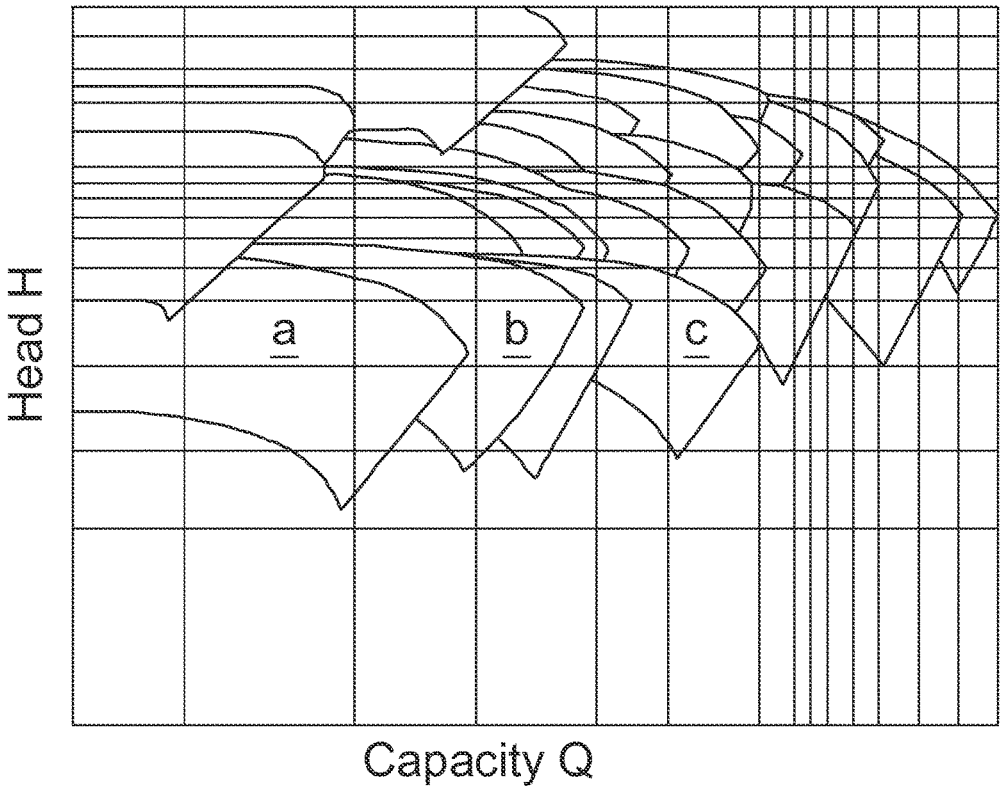
FIG. 8 illustrates an exemplary overall hydraulic coverage chart of a centrifugal pump series.

FIG. 8 illustrates schematically an overall hydraulic coverage chart of a conventional centrifugal pump series at a constant value for revolutions per minute. In the horizontal axis capacity Q is shown and in the vertical axis head H. More specifically, axes shown in FIG. 8 are in logarithmic scale i.e. log-log scale. The conventional pump series consists of different pumps sizes having different hydraulic coverages as illustrated in FIG. 8. Some of the coverage curves of the different pumps overlap. As an example, different hydraulic coverage charts of three different pump sizes are indicated by letters 'a', 'b' and 'c'. With the help of the overall hydraulic coverage chart, customer may choose the right pump for their needs and using the overall hydraulic coverage chart, the suction specific speeds can be calculated. Namely, the overall hydraulic coverage chart may also show the best efficiency points.

When a centrifugal pump series includes volute casing designs as shown in FIGS. 1-6, wherein the adapter section comprises a convex curvature surface reducing cross-sectional flow area, it provides a substantially constant suction specific speed that varies less than 3% in the centrifugal pump series, preferably less than 2% and most preferably less than 1%. The variation of 3% means that the centrifugal pump series has an average NSS and that the NSS of each and every individual pump in the series fits within the average NSS±1.5%

As an example, according to an embodiment of the present invention, a centrifugal pump series has a suction specific speed in a range of 270-275 when computed in the SI units that is the suction specific speed varies about 1.8%. On the other hand, the suction specific speed in the corresponding conventional centrifugal pump series is in a range of 255-285 when the suction specific speed is computed in SI units that is the suction specific speed varies about 11%.

The same features in the figures are shown using the same reference characters. It should be noted that only the parts necessary to the invention are shown in the figures while the volute casing comprises several parts. For instance, the volute casing may comprise a wear plate facing the front edges of the working vanes of the impeller in the manner of the front wall 26 of FIG. 1, the wear plate being a replaceable and axially adjustable annular plate that extends from the intake channel 12 up to the annular wall 18 of the volute. The purpose of the wear plate is to protect the volute casing 10 itself when pumping such medium that tends to wear the components used for pumping. Another purpose of the wear plate is to be able to adjust the running clearance of the impeller 30. In addition, it should be noted that the volute 16 may be formed of two separate parts i.e. by forming the annular wall 18 of two parts. In the latter case the diameter of the rear wall opening may be smaller than that of the impeller 30.

It should be noted that in this context the cross section of the annular convex curvature surface S in 2-dimensional space is in all discussed embodiments of the present invention either a portion of a circle, a portion of an ellipse or any combination thereof. Preferably, the portion of the cross section is less than or equal to a quarter of the circle or a quarter of the ellipse. The convex curvature surface S forms an annular surface that is convex against the direction of flow F.

While the invention has been described herein by way of examples in connection with what are, at present, considered to be the most preferred embodiments, it is to be understood that the invention is not limited to the disclosed embodiments, but is intended to cover various combinations or modifications of its features, and several other applications included within the scope of the invention, as defined in the appended claims. The details mentioned in connection with any embodiment above may be used in connection with another embodiment when such combination is technically feasible.

What is claimed is:

1. An intake channel arrangement for a volute casing of a centrifugal pump, comprising:

an intake channel comprising a first end with a first inner diameter, and a second end with a second inner diameter, the second inner diameter being smaller than the first inner diameter, a cross-sectional flow area and an adapter section arranged between the first end and the second end, a first channel portion with a surface and the first inner diameter, an annular convex curvature surface joining at an angle to the surface of the first channel portion, the angle being in a range of 90° -110° between the surface of the first channel portion and a tangent of the convex curvature surface having a tangent point in an intersection of the surface of the first channel portion and the convex curvature surface, the annular convex curvature surface reducing the cross-sectional flow area from the first inner diameter to the second inner diameter and the first inner diameter being chosen to correspond to a first predetermined inner diameter greater than the second diameter.

2. The intake channel arrangement according to claim 1, wherein the intake channel includes, between the adapter section and the second end, a second channel portion having the second inner diameter.

3. The intake channel arrangement according to claim 2, further comprising a separate flange member comprising the first end and the adapter section.

4. The intake channel arrangement according to claim 3, wherein the second channel portion has a flange for attaching the separate flange member thereto.

5. The intake channel arrangement according to claim 2, wherein the convex curvature surface joins tangentially to the inner surface of the second channel portion.

6. The intake channel arrangement according to claim 2, wherein the first channel portion is shorter than the second channel portion.

7. The intake channel arrangement according to claim 1, wherein the first channel portion is disposed between the first end and the adapter section.

8. The intake channel arrangement according to claim 7, further comprising a flange at the first channel portion of the intake channel.

9. The intake channel arrangement according to claim 7, further comprising a flange disposed at the first end of the intake channel.

10. The intake channel arrangement according to claim 1, wherein the convex curvature surface has a cross section in an axial plane, the cross section being one at least one of a part of a circle and a part of an ellipse.

11. A volute casing of a centrifugal pump comprising the intake channel arrangement of claim 1.

12. A centrifugal pump comprising the intake channel arrangement of claim 1.

13. A flange member for positioning between an inlet pipeline and an inlet flange of a centrifugal pump, comprising:

the flange member having a cross-sectional flow area;

a first inner diameter;

a second inner diameter, the first inner diameter corresponding to a first predetermined pipeline inner diameter greater than the second diameter;

a first channel portion having a surface and the first inner diameter; and an annular convex curvature surface configured to reduce the cross sectional flow area from the first inner diameter to the second inner diameter, the annular convex curvature surface joining at an angle to the surface of the first channel portion, the angle being in a range of 90°-110° between the surface of the first channel portion and a tangent of the convex curvature surface having a tangent point in an intersection of the surface of the first channel portion and the convex curvature surface.

14. The flange member according to claim 13, wherein the second diameter corresponds to an inlet diameter of the centrifugal pump.

* * * * *